US006666737B1

(12) United States Patent
Matsuo

(10) Patent No.: US 6,666,737 B1
(45) Date of Patent: Dec. 23, 2003

(54) COOLING SYSTEM FOR JET PROPULSION BOAT

(75) Inventor: Hisashi Matsuo, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/231,012

(22) Filed: Aug. 30, 2002

(30) Foreign Application Priority Data

Sep. 5, 2001 (JP) ..... 2001-269428

(51) Int. Cl.[7] ..... B63H 11/00; B63H 21/38

(52) U.S. Cl. ..... 440/39; 440/88 C; 440/88 G; 440/88 N

(58) Field of Search ..... 440/39, 88 C, 440/88 D, 88 G, 88 J, 88 M, 88

(56) References Cited

U.S. PATENT DOCUMENTS 3,550,612 A * 12/1970 Maxon ..... 137/112
4,133,284 A * 1/1979 Holcroft ..... 440/88 R
5,746,054 A * 5/1998 Matte ..... 60/310
6,379,201 B1 * 4/2002 Biggs et al. ..... 440/88 R
2003/0024491 A1 * 2/2003 Kinomoto et al. ..... 123/41.14

FOREIGN PATENT DOCUMENTS

JP 2-86899 7/1990

* cited by examiner

*Primary Examiner*—Sherman Basinger
(74) *Attorney, Agent, or Firm*—Birch, Stewart, Kolasch & Birch, LLP

(57) ABSTRACT

To provide a cooling system for a jet propulsion boat in which the quantity of washing water consumed can be reduced and the appearance is improved. The cooling system for a jet propulsion boat forces the engine to be cooled and forces the exhaust system to be cooled by taking a part of a jet of water emitted from the jet pump (shown in FIG. 1) into the intake path as cooling water and diverging the cooling water taken into the intake path at the diverging duct in a one-way valve unit to flow into the engine-cooling flow path and the exhaust-system-cooling flow path. The cooling system for a jet propulsion boat is provided with a one-way valve at the midsection of the intake path for enabling cooling water to flow from the intake path to the diverging duct and preventing washing water from flowing from the diverging duct towards the intake path.

20 Claims, 14 Drawing Sheets

COOLING SYSTEM FOR JET PROPULSION BOAT

CROSS-REFERENCE TO RELATED APPLICATIONS

The present application claims priority under 35 USC 119 to Japanese Patent Application No. 2001-269428 filed on Sep. 5, 2001 the entire contents thereof is hereby incorporated by reference.

BACKGROUND OF THE INVENTION

1. Field of the Invention

The present invention relates to a cooling system for a jet propulsion boat provided with a jet propulsion unit in a pump chamber in a vessel body that is propelled by driving the jet propulsion unit by an engine wherein the exhaust gas is discharged from the engine into the pump chamber.

2. Description of Background Art

The jet propulsion boat is a vessel provided with a jet pump mounted at the rear portion of the vessel body. The vessel is propelled by sucking water from the bottom of the vessel by driving the jet pump by the engine and discharging the sucked water rearwardly. The jet propulsion boat is provided with a cooling system for cooling the engine or an exhaust system with water while being propelled.

A cooling system for a jet propulsion boat is disclosed in Japanese Utility Model Laid-Open No. 86899/1990 that is entitled "WASHING UNIT FOR VESSEL PROPELLER." The cooling system for a jet propulsion boat will be described referring FIG. 1 of this publication that is illustrated hereinafter as FIG. 15 which is a side view showing a jet propulsion boat of the related art.

A jet propulsion boat 100 is provided with an engine-cooling flow path 102 for cooling an engine 101. The engine-cooling flow path 102 takes a part of a jet of water into an intake path 103 as cooling water and guides the cooling water to an engine-cooling duct (as an example, a jacket water) through the intake path 103 for cooling the engine 101 by flowing cooling water through the engine-cooling flow path, and discharges the cooling water to the outside through a drainage duct 105.

The intake path 103 is a flow path being capable of taking a part of a jet of water as cooling water by positioning an intake port 103*a* toward a jet pump 107. The drainage duct 105 is capable of discharging cooling water to the outside of a vessel body 110 by disposing a discharge port 105*a* at a front outer wall 110*a* of the vessel body 110.

The engine-cooling flow path 102 cools the engine 101 with water by providing cooling water during operation of the jet propulsion boat 100. When washing the jet propulsion boat 100, the engine-cooling flow path 102 may be washed with tap water by supplying washing water (for example, tap water) to the discharge port 105*a* of the drainage duct 105.

Generally, the jet propulsion boat 100 is provided with an exhaust-system-cooling flow path for cooling the exhaust system in addition to the engine-cooling flow path 102 for cooling the engine 101. As a means for cooling the exhaust system, the exhaust-system-cooling flow path is constructed to be provided in series with the engine-cooling flow path 102. In addition, a construction is available wherein the exhaust-system-cooling flow path and the engine-cooling flow path 102 are provided in parallel.

According to the construction in which the exhaust-system-cooling flow path is provided in series with the engine-cooling flow path 102, cooling water used for cooling the engine 101 is also utilized for cooling the exhaust system.

Therefore, since cooling water flows through the engine-cooling flow path 102 and subsequently into the exhaust-system-cooling flow path, the temperature of cooling water in the engine-cooling flow path 102 increases to some extent, which makes preferable control of the temperature of the exhaust system difficult.

On the other hand, according to the structure in which the exhaust-system-cooling flow path and the engine-cooling flow path 102 are provided in parallel, cooling water flowing in the engine-cooling flow path 102 and cooling water flowing in the exhaust-system-cooling flow path are flow separately, and thus it is easy to control the temperature of the exhaust system preferably.

However, when the engine-cooling flow path 102 and the exhaust-system-cooling duct are provided in parallel, washing water has to be diverged and flows simultaneously into both the engine-cooling flow path 102 and the exhaust-system-cooling duct when washing, which results in an increase in the quantity of washing water consumed.

The jet propulsion boat 100 in the above mentioned publication discharges cooling water used for cooling the engine-cooling flow path 102 to the outside through the discharge port 105*a* of the drainage duct 105. However, since the discharge port 105*a* of the drainage duct 105 is disposed on the front outer wall 110*a* of the vessel body 110, the discharge port 105*a* of the drainage duct 105 can be seen from the outside, which is not preferable in terms of appearance of the jet propulsion boat 100.

SUMMARY AND OBJECTS OF THE INVENTION

Accordingly, it is an object of the present invention to provide a cooling system for a jet propulsion boat in which the quantity of washing water consumed can be reduced and the appearance of the boat improved.

In order to solve the problem, the present invention provides a jet propulsion boat comprising a jet pump chamber provided in the rear portion of a vessel body with a jet propulsion unit provided in the jet pump chamber wherein a jet of water is emitted for propulsion by driving the jet propulsion unit with an engine. A part of the jet of water is taken into an intake path as cooling water. The cooling water taken into the intake path is diverging into the diverging duct and flows into an engine-cooling flow path and an exhaust-system-cooling flow path for cooling the engine and for cooling the exhaust system. A one-way valve is provided that is capable of opening for allowing cooling water to flow from the intake path towards the diverging duct and is capable of closing for preventing washing water from flowing from the diverging duct into the intake path. The one-way valve is provided in the middle of the intake path.

The one-way valve for enabling cooling water to flow from the-intake path into the diverging duct and preventing washing water from flowing from the diverging duct into the intake path is provided in the middle of the intake path.

As a consequent, when operating the jet propulsion boat, cooling water taken into the intake path can flow into the diverging duct through the one-way valve, and cooling water flowing into the diverging duct can be diverged at the diverging duct and flows into the engine-cooling flow path and the exhaust-system-cooling flow path.

On the other hand, when washing the jet propulsion boat, washing water can be prevented from flowing from the diverging duct into the intake path with the one-way valve. Accordingly, it is possible to supply washing water into the engine-cooling flow path for washing the engine-cooling flow path with the supplied washing water and then to supply the used washing water to the exhaust-system-cooling flow path through the one-way valve.

In the present invention a cooling water discharge port of the engine-cooling flow path is disposed in the vicinity of the opening at the rear end of the jet pump chamber.

With the provision of a cooling water discharge port of the engine-cooling flow path in the vicinity of the opening at the rear end of the jet pump chamber, the cooling water discharge port can be hidden by the jet pump chamber. Accordingly, a construction wherein the cooling water discharge port cannot be viewed is realized.

With the provision of the cooling water discharge port in the vicinity of the opening at the rear end of the jet pump chamber, it is possible to insert a hand from the opening at the rear end of the jet pump chamber into the pump chamber and to easily touch the cooling water discharge port with the inserted hand. Therefore, even when tap water is used as washing water, a tap water hose can be attached to the cooling water discharge port relatively easily.

In the present invention a one-way valve is provided with a flow path for communicating a small quantity of washing water from the diverging duct into the intake path when closed.

When the one-way valve is closed, the flow path for flowing a small quantity of washing water (hereinafter referred to as "fine flow path") can be kept opened, and thus a small quantity of washing water can flow from the diverging duct toward the intake path through the fine flow path. Therefore, the jet pump can easily be washed with a small quantity of washing water passing through the fine flow path.

In addition, by limiting the quantity of washing water to pass through the fine flow path, most parts of washing water used for washing the engine-cooling flow path can flow into the exhaust-system-cooling flow path. Therefore, the exhaust-system-cooling flow path can be washed preferably without taking too much time.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
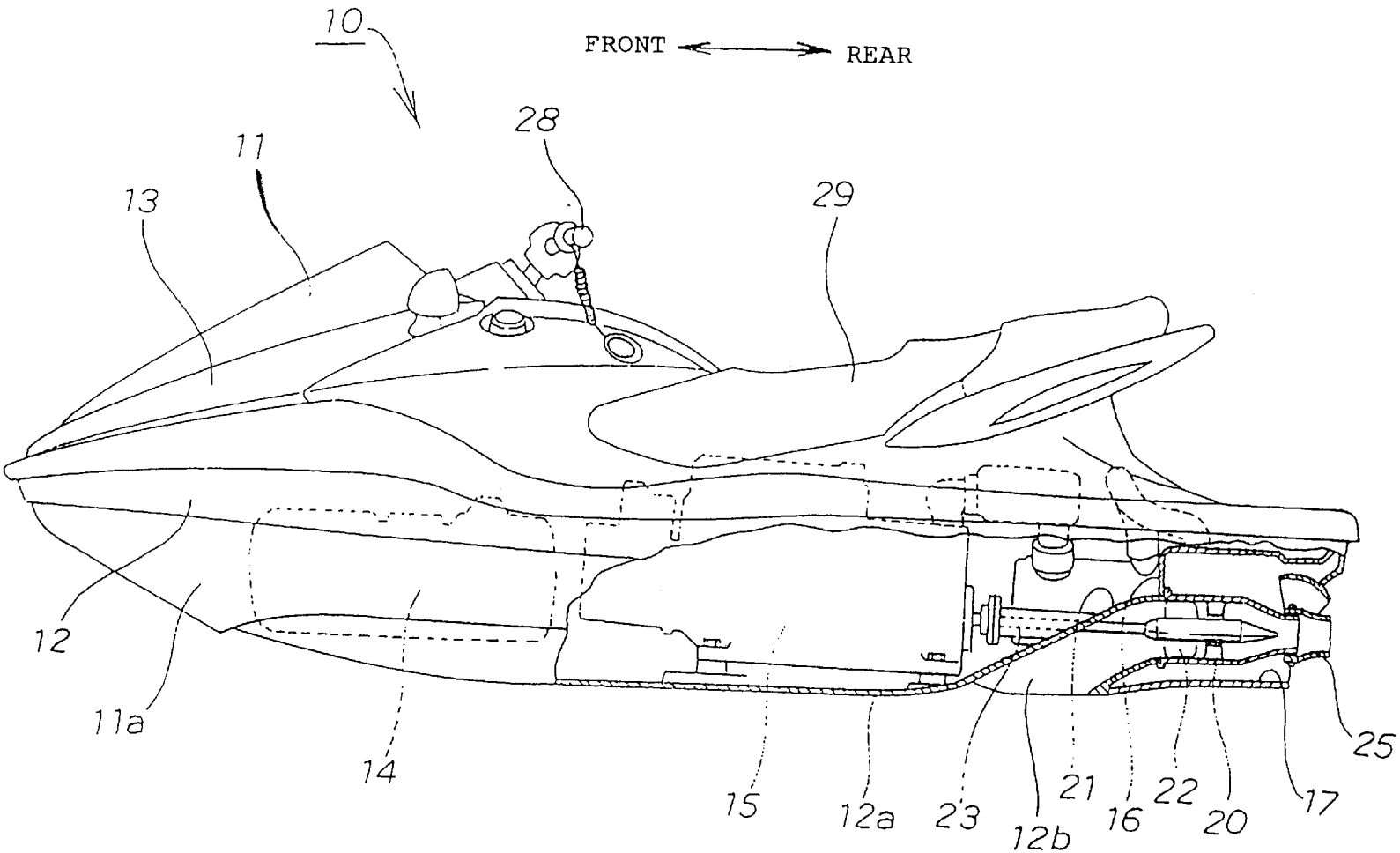
FIG. 1 is a side view of a jet propulsion boat provided with a cooling system according to the present invention.

Referring now to the drawings, an embodiment of the present invention will be described below wherein FIG. 1 is a side view of a jet propulsion boat provided with a cooling system according to the present invention.

The jet propulsion boat 10 comprises a vessel body 11 including a lower hull 12 having a ship bottom 12*a* and an upper hull 13 superimposed thereon. A fuel tank 14 is mounted on the front portion 11*a* of the vessel body 11. An engine 15 is provided rearwardly of the fuel tank 14 with a jet pump chamber 16 provided rearwardly of the engine 15. A jet pump (jet propulsion unit) 20 is provided in the jet pump chamber 16 with a steering handle 28 mounted upwardly of the fuel tank 14. A saddle-riding type seat 29 is mounted rearwardly of the steering handle 28. A cooling system for the jet propulsion boat will be described later.

The jet pump 20 has a housing 21 extending rearwardly from an opening 12*b* on the ship bottom 12*a* with an impeller 22 rotatably mounted in the housing 21. The impeller 22 is connected to a drive shaft 23 of the engine 15.

With the jet pump 20, by driving the engine 15 and thus rotating the impeller 22, water is sucked through the opening 12*b* on the ship bottom 12*a* and emitted through the housing 21 from a steering pipe (steering nozzle) 25.

With the provision of the steering nozzle 25 at an opening 17 at the rear end of the jet pump chamber 16, a jet of water emitted from the steering nozzle 25 can be emitted from the opening 17 at the rear end of the jet pump chamber 16 rearwardly of the vessel body 11.

The steering nozzle 25 is a member mounted at the rear end of the housing 21 so as to be capable of being swung freely in the lateral direction. The steering nozzle 25 is a nozzle to be used for steering the direction of the vessel body 11 by being swung in the lateral direction via the steering handle 28.

The jet propulsion boat 10 can be propelled by supplying fuel to the engine 15 from the fuel tank 14 for driving the engine 15, transmitting the driving force of the engine 15 to an impeller 24 through the drive shaft 23, sucking water through the opening 12*b* of the ship bottom 12*a* by rotating the impeller 24, and emitting a jet of water from the steering nozzle 25 through the rear end of the housing 21.

Figure 2:
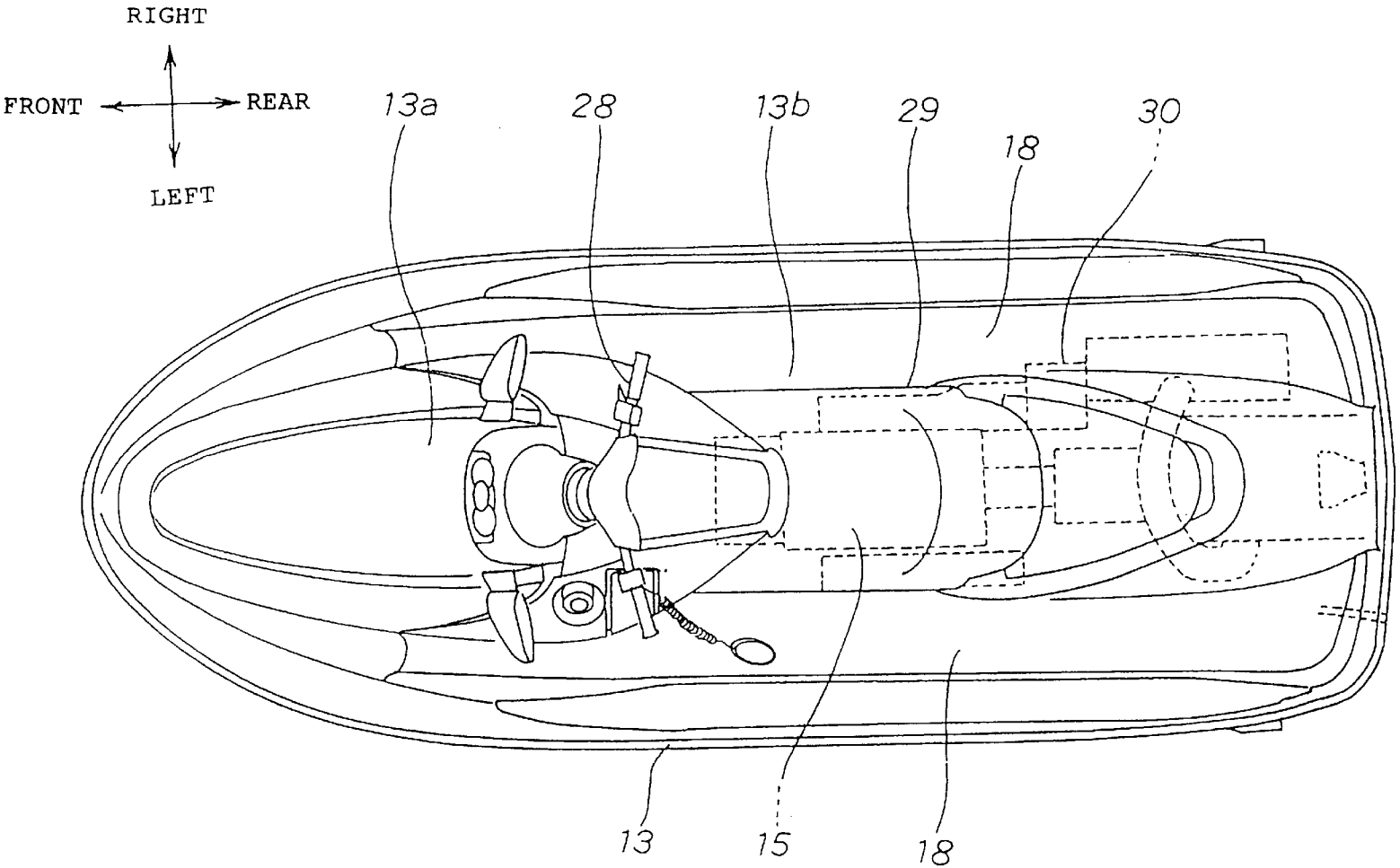
FIG. 2 is plan view of the jet propulsion boat provided with the cooling system according to the present invention.

FIG. 2 is a plan view of the jet propulsion boat provided with a cooling system according to the present invention, showing a state in which the steering handle 28 is provided on the upper front portion 13*a* of the upper hull 13 with the saddle-riding type seat 29 extending in the fore-and-aft direction rearwardly of the steering handle 28 at the center 13*b* of the upper surface of the upper hull 13 (widthwise center). Footrest decks 18 are provided on the left side and the right side of the saddle-riding type seat 29. The engine 15 and an exhaust system 30 are provided in the vessel body 11 with the cooling system being provided for cooling the jet propulsion boat (described later) and for cooling the engine 15 and the exhaust system 30.

Figure 3:
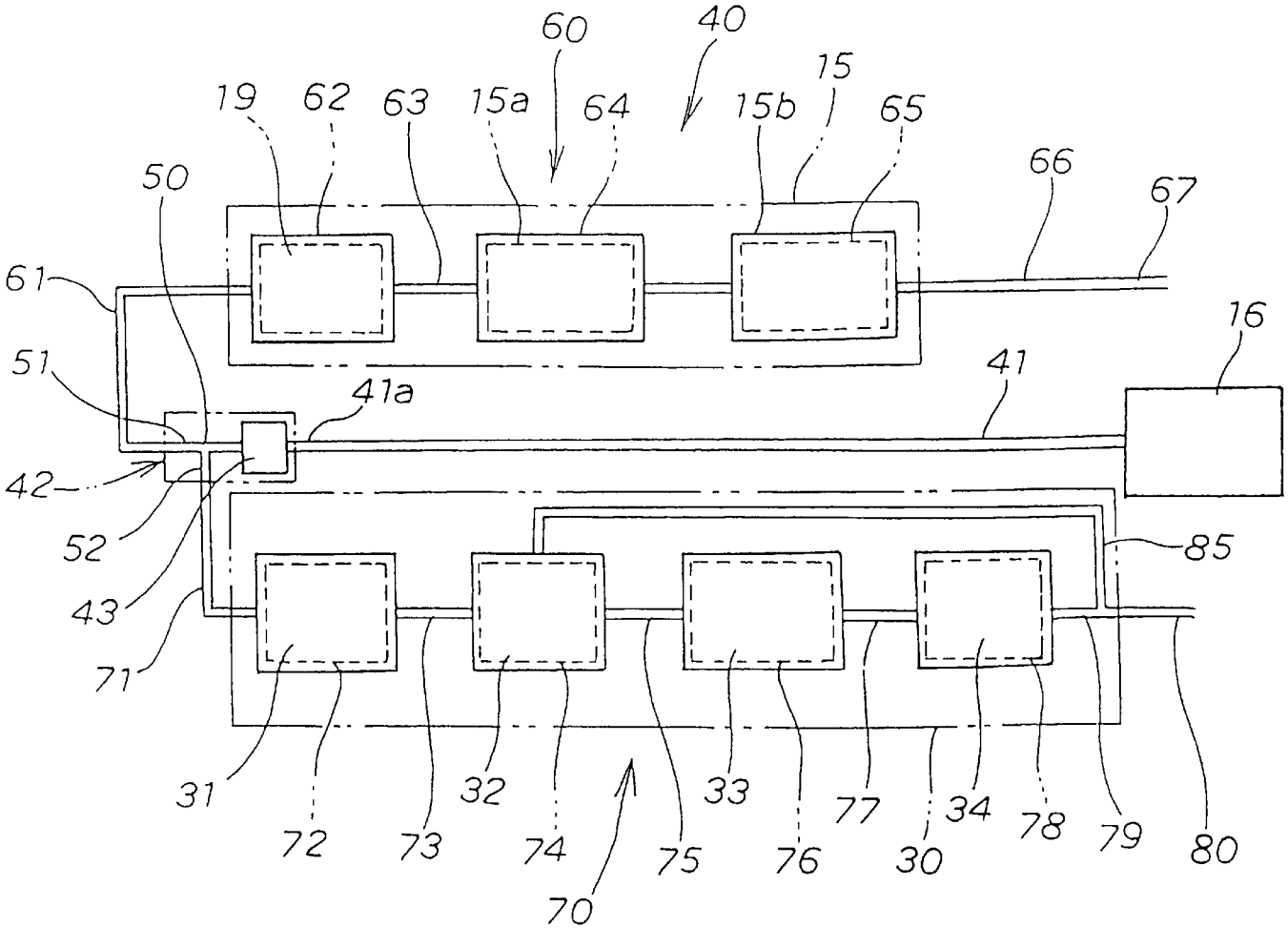
FIG. 3 is a block diagram of the cooling system for a jet propulsion boat according to the present invention.

FIG. 3 is a block diagram of the cooling system for a jet propulsion boat according to the present invention.

The cooling system 40 for a jet propulsion boat forces the engine 15 to be cooled and forces the exhaust system 30 to be cooled by taking a part of a jet of water emitted from the jet pump 20 (shown in FIG. 1) into an intake path 41 as cooling water and diverging the cooling water taken into the intake path 41 at a diverging duct 50 in a one-way valve unit 42 for flowing the cooling water into the engine-cooling flow path 60 and the exhaust-system-cooling flow path 70.

The intake path 41*a* is provided with the one-way valve unit 42 at a discharge port 41*a*, and the one-way valve unit 42 is provided with a one-way valve 43 integrated therein at the intake path 41 side. A diverging duct 50 is integrally provided on the opposite side of the intake path 41.

The engine-cooling flow path 60 is connected to a first diverged discharge port 51 diverged by the diverging duct 50. The exhaust-system-cooling flow path 70 is connected to a second diverged discharge port 52 diverged by the diverging duct 50.

The engine-cooling flow path 60 is constructed in such a manner that the feed port of an oil-cooler-cooling duct (cooling water jacket) 62 is connected to the first diverged discharge port 51 via a first engine-cooling flow path 61. The discharge port of the oil-cooler-cooling duct 62 is connected to the feed port of a cylinder-block-cooling duct (cooling water jacket) 64 via a second engine-cooling flow path 63. The discharge port of the cylinder-block-cooling duct 64 is connected to the feed port of a cylinder-head-cooling duct (cooling water jacket) 65. The discharge port of the cylinder-head-cooling-duct 65 is connected to the intake port of a third engine-cooling flow path 66 with a cooling water discharge port 67 of the third engine-cooling flow path 66 facing towards the interior of the jet pump chamber 16 (See FIG. 1).

The exhaust-system-cooling flow path 70 is constructed in such a manner that the feed port of an intercooler-cooling duct (cooling water jacket) 72 is connected to a second diverged discharge port 52 via a first exhaust-system-cooling flow path 71. The discharge port of the intercooler-cooling duct 72 is connected to the feed port of an exhaust-manifold-cooling duct (cooling water jacket) 74 via a second exhaust-system-cooling flow path 73. The discharge port of the exhaust-manifold-cooling duct 74 is connected to the feed port of a turbocharger-cooling duct (cooling water jacket) 76 via a third exhaust-system-cooling flow path 75 with the discharge port of the turbocharger-cooling duct 76 being connected to an exhaust-pipe-cooling duct (cooling water jacket) 78 via a fourth exhaust-system-cooling flow path 77. The intake port of a fifth exhaust-system-cooling flow path 79 is connected to the discharge port of the exhaust-pipe-cooling duct 78 and a cooling water drain 80 at the rear end 79*b* of the fifth exhaust-system-cooling flow path 79 is provided on the rear surface 11*b* of the vessel body 11 except for the portion 29*a* immediately behind the saddle-riding type seat 29 shown in FIG. 2.

Figure 4:
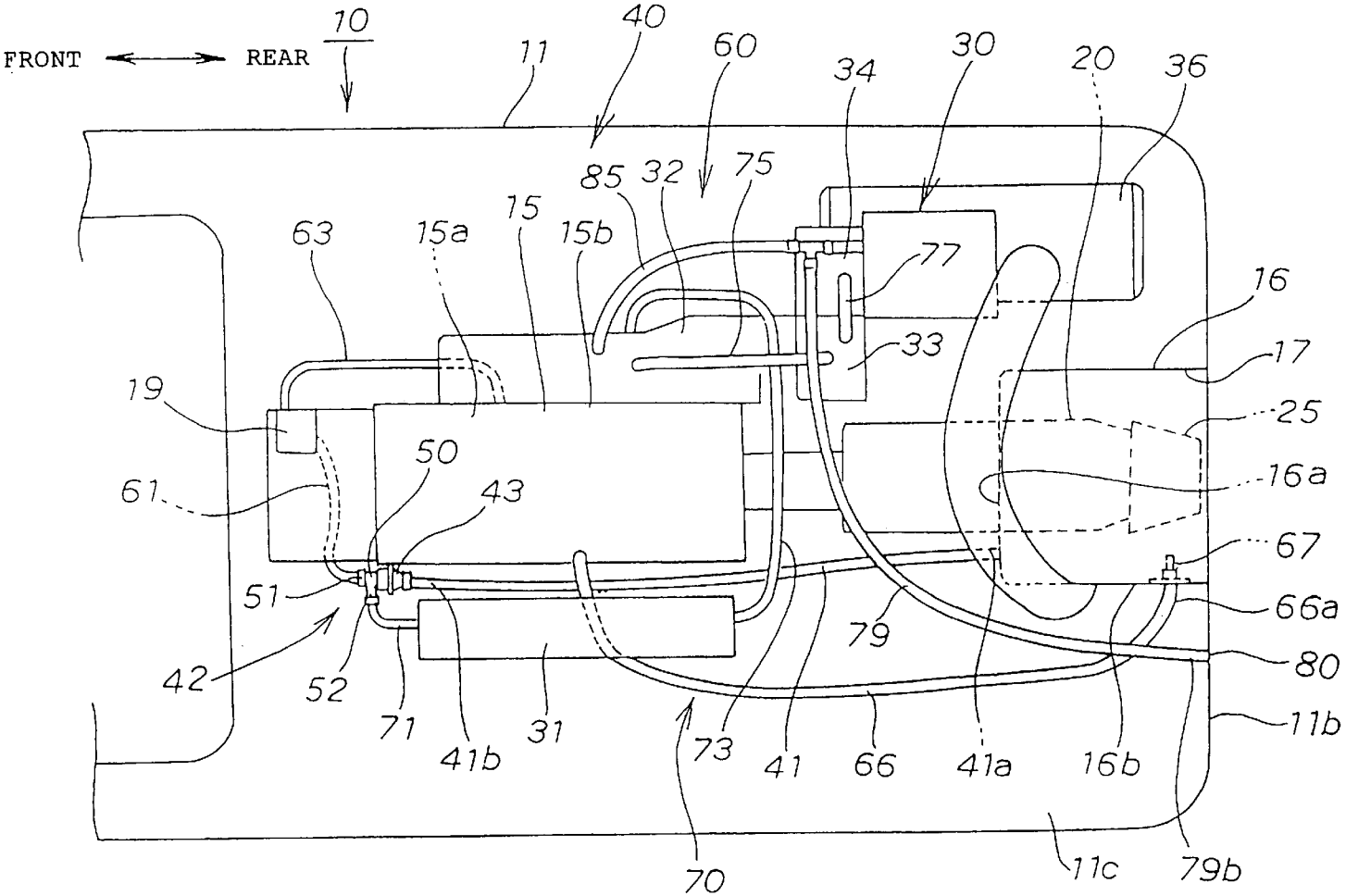
FIG. 4 is a plan view of the cooling system for a jet propulsion boat according to the present invention.

The portion where the cooling water drain 80 is to be provided is described to be the rear surface 11*b* of the vessel body 11, more specifically, it corresponds to the portion in the vicinity of the left side wall as shown in FIG. 4.

A by-pass flow path 85 is provided for preferably adjusting the flow rate of cooling water.

FIG. 4 is a plan view of the cooling system for a jet propulsion boat according to the present invention, showing a state in which the jet pump chamber 16 is provided in the rear portion 11*c* of the vessel body 11. The jet pump 20 is provided in the jet pump chamber 16 with the engine 15 being provided forwardly of the jet pump 20. The drive shaft 23 (shown in FIG. 1) of the engine 15 is connected to the jet pump 20 with the steering nozzle 25 of the jet pump 20 facing towards the opening 17 at the rear end of the jet pump chamber 16.

The jet propulsion boat 10 can be propelled by emitting a jet of water from the steering nozzle 25 by driving the jet pump 20 with the engine 15 and injecting a jet of water from the opening 17 at the rear end of the jet pump chamber 16 rearwardly of the vessel body 11.

The cooling system 40 for a jet propulsion boat can force the engine 15 and the exhaust system 30 to be cooled respectively by taking a part of a jet of water emitted from the jet pump 20 into the intake path 41 as cooling water and diverging the cooling water taken into the intake path 41 at the diverging duct 50 of the one-way valve unit 42 and providing the cooling water into the engine-cooling flow path 60 and the exhaust-system-cooling flow path 70.

The intake path 41 is constructed in such a manner that the rear end 41*a* is attached to a front wall 16*a* of the jet pump chamber 16 and the intake port (not shown) at the rear end 16*a* is connected to the jet pump 20 and is arranged so as to extend forward along the left side surface of the jet pump 20 and the left side surface of the engine 15 with the discharge port at the front end 41*b* disposed in the vicinity of the front end of the engine 15.

The one-way valve unit 42 is provided at the front end 41*b* of the intake path 41. The one-way valve unit 42 is provided with the one-way valve 43 on the side of the intake path 41 and the diverging duct 50 on the opposite side from the intake path 41 integrally formed therewith.

The engine-cooling flow path 60 is connected to the first diverged discharge port 51 diverged by the diverging duct 50, and the exhaust-system-cooling flow path 70 is connected to the second diverged discharge port 52 diverged by the diverging duct 50.

The engine-cooling flow path 60 is constructed in such a manner that the first diverged discharge port 51 is connected to the cooling duct of an oil cooler 19 via the first engine-cooling flow path 61, the cooling duct of the oil cooler 19 is connected to the cooling duct of a cylinder block 15*a* via the second engine-cooling flow path 63, the cooling duct of the cylinder head 15*a* is connected to the cooling duct of the cylinder head 15*b*, the cooling duct of the cylinder head 15*b* is connected to the intake port of the third engine-cooling flow path 66, and the rear end 66*a* of the third engine-cooling flow path 66 is attached to the left side wall 16*b* of the jet pump chamber 16, so that the cooling water drain 67 at the rear end 66*a* faces towards the interior of the jet pump chamber 16 and is disposed in the vicinity of the opening 17 at the rear end of the jet pump chamber 16.

The exhaust-system-cooling flow path 70 is constructed in such a manner that the cooling duct of an intercooler 31 is connected to the second diverged discharge port 52 via the first exhaust-system-cooling flow path 71, the cooling duct of the inter cooler 31 is connected to the cooling duct of an exhaust manifold 32 via the second exhaust-system-cooling flow path 73, the cooling duct of the exhaust manifold 32 is connected to the cooling duct of a turbocharger 33 via the third exhaust-system-cooling flow path 75, the cooling duct of the turbocharger 33 is connected to the cooling duct of an exhaust pipe 34 via the fourth exhaust-system-cooling flow path 77, the intake port of the fifth exhaust-system-cooling flow path 79 is connected to the cooling duct of the exhaust pipe 34, and the cooling water discharge port 80 at the rear end 79*a* of the fifth exhaust-system-cooling flow path 79 is provided on the rear surface 11*b* of the vessel body 11 except for the portion 29*a* immediately behind the saddle-riding type seat 29 (as shown in FIG. 2).

Figure 5:
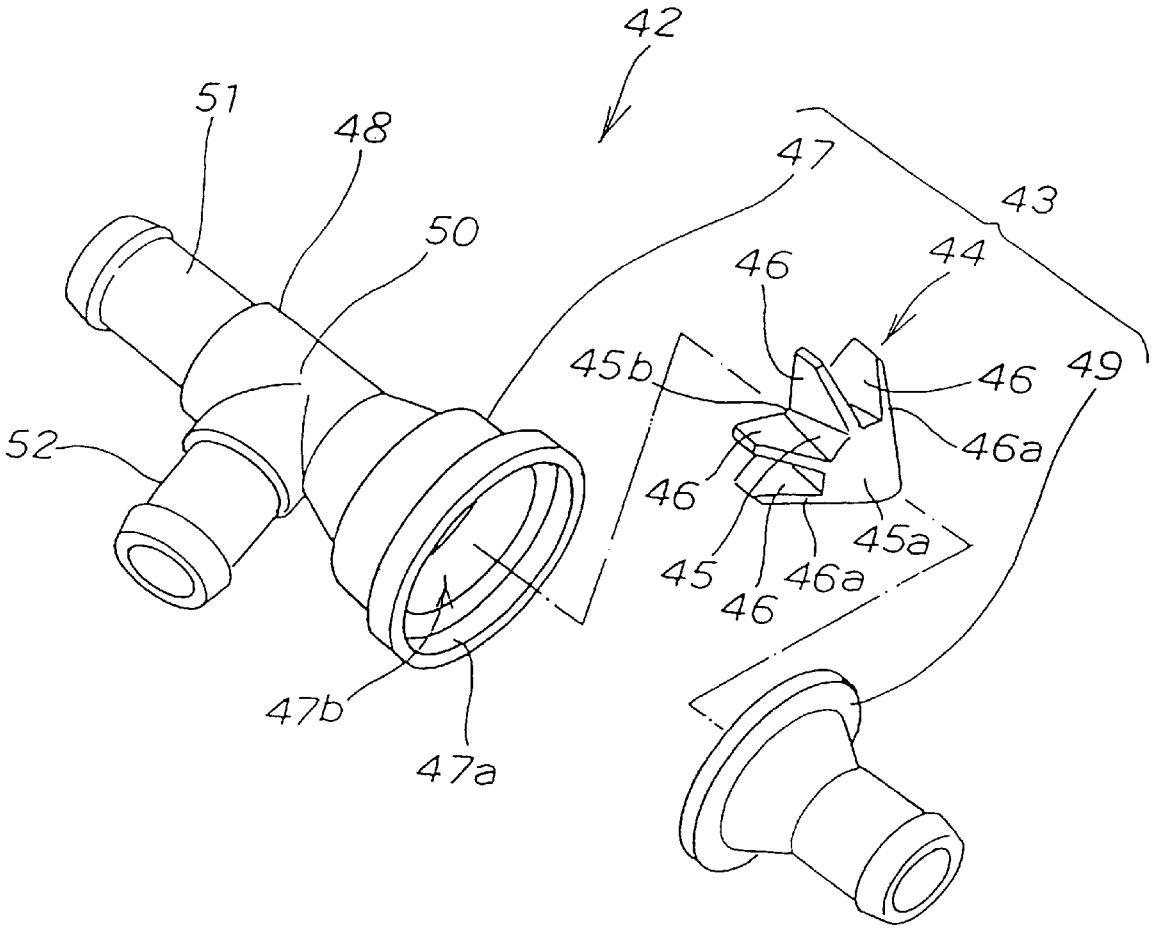
FIG. 5 is an exploded perspective view of a one-way valve unit constituting the cooling system for a jet propulsion boat according to the present invention.

FIG. 5 is an exploded perspective view of the one-way valve unit constituting the cooling system for a jet propulsion boat according to the present invention.

The one-way valve unit 42 comprises a body 48 including a casing 47 for accommodating a valve body 44 of the one-way valve 43 and a diverging duct 50, the valve body 44 is accommodated in a storage recess 47*b* from an opening 47*a* of the casing 47, and a cap 49 for covering the opening 47*a* with the valve body 44 stored in the storage recess 47*b*.

The valve body 44 comprises a core portion 45 formed into the shape of a tapered cone at an extremity 45*a* thereof. The core portion 45 is formed so that the diameter thereof is reduced gradually from the conical extremity 45*a* toward a proximal portion 45*b*. A plurality of (six) blades 46 . . . extend radially from the outer surface of the core portion 45. The plurality of blades 46 . . . have front end surfaces 46*a* . . . formed into inclined surfaces being flush with the outer periphery of the conical extremity 45*a*.

Figure 6A:
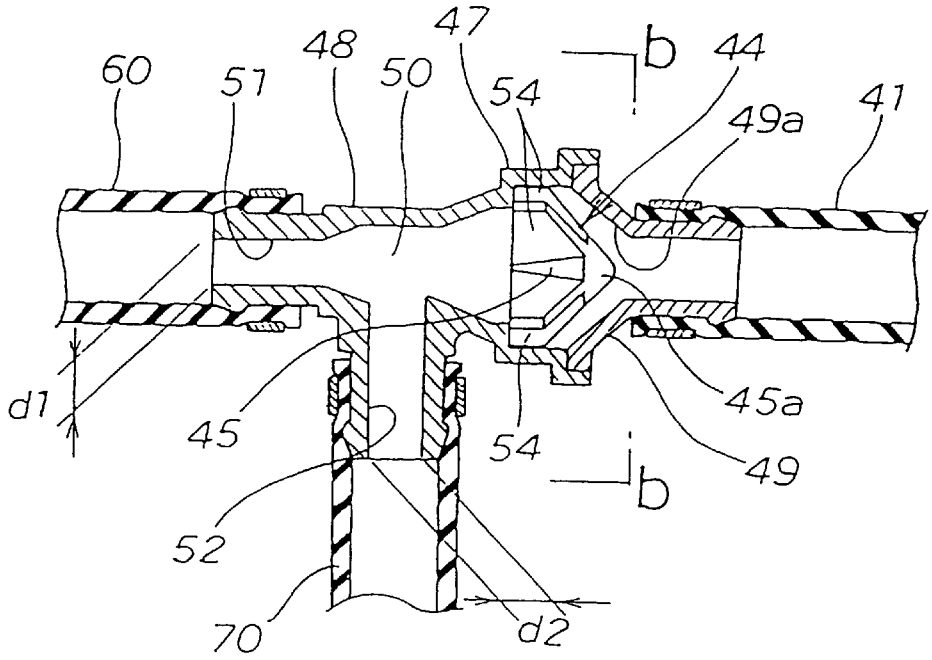
FIGS. 6(*a*) and 6(*b*) show explanatory drawings illustrating the one-way valve unit constituting the cooling system for a jet propulsion boat according to the present invention.
Figure 6B:
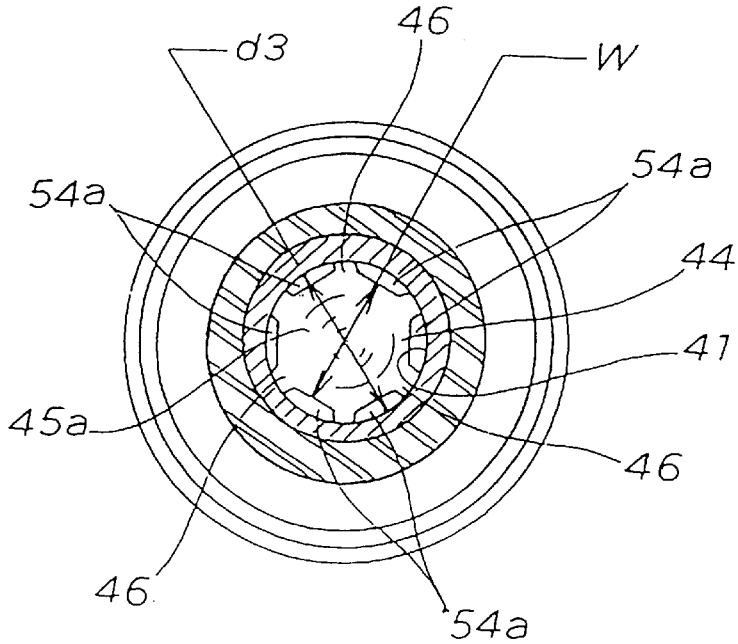

FIGS. 6(*a*) and 6(*b*) are explanatory drawings illustrating the one-way valve unit constituting the cooling system for a jet propulsion boat according to the present invention. FIG. 6(*a*) is a cross-sectional view and FIG. 6(*b*) is a cross-sectional view taken along the line b—b of the FIG. 6(*a*).

The diverging duct 50 provided in the body 48 is intended to divert the intake path 41 into the first diverged discharge port 51 and the second diverged discharge port 52. The first diverged discharge port 51 is connected to the engine-cooling flow path 60 and the second diverged discharge port 52 is connected to the exhaust-system-cooling flow path 70.

The one-way valve 43 is operated in such a manner that when cooling water flows from the intake path 41 towards the valve body 44, the valve body 44 is moved away from a valve seat 49*a* by the hydraulic pressure of the cooling water and is retained in a state being away from the valve seat 49*a* (the state shown in the FIG. 6(*a*)).

In addition, the one-way valve 43 is further operated in such a manner when washing water is flowing from the first diverged discharge port 51 towards the valve body 44, the valve body 44 is moved towards the valve seat 49*a* by the hydraulic pressure of washing water and bought into abutment with the valve seat 49*a*.

Moving the valve body 44 away from the valve seat 49*a* allows cooling water to flow through the spaces 54 . . . between the blade 46 and the blade 46, and thus cooling water can flow from the intake path 41 towards the diverging duct 50.

On the other hand, bringing the valve body 44 into abutment with the valve seat 49*a* may prevent washing water flowing from the first diverged discharge port 51 into the diverging duct 50 from flowing into the intake path 41.

The inner diameter d1 of the first diverged discharge port 51 may be 8mm for example, and the inner diameter d2 of the second diverged discharge port 52 may be 10mm for example. The relation between the inner diameter d1 and the inner diameter d2 is d1<d2.

As shown in the FIG. 6(*b*), by determining the maximum width W of the extremity 45*a* of the valve body 44 to be smaller than the inner diameter d3 of the intake path 41, parts of the spaces 54 . . . between the blades 46 of the valve body 44 (fine flow paths) 54*a* . . . may be placed in the intake path 41. The inner diameter d3 may be 12 mm for example.

With the valve body 44 constructed as described above, when the valve body 44 abuts against the valve seat 49*a*, fine flow paths 54*a* . . . may be provided between the valve seat 49*a* and the valve body 44 as flow paths for allowing a small quantity of washing water.

Therefore, a small quantity of washing water out of washing water flowing from the first diverged discharge port 51 to the diverged duct 50 may flow through the fine flow paths 54*a* . . . to the side of the intake path 41.

As a consequent, the interior of the jet pump 20 (shown in FIG. 1) can easily be washed with a small quantity of washing water passing through the fine flow paths 54*a* . . . Therefore, the jet propulsion boat 10 (shown in FIG. 1) can be washed effectively without taking too much time and effort.

In addition, since the quantity of washing water that passes through the fine flow paths 54*a* . . . is small, most of the cooling water used for cooling the engine-cooling path 60 may be supplied to the exhaust-system-cooling flow path 70. Therefore, the exhaust-system-cooling flow path 70 may be washed satisfactorily.

Figure 7:
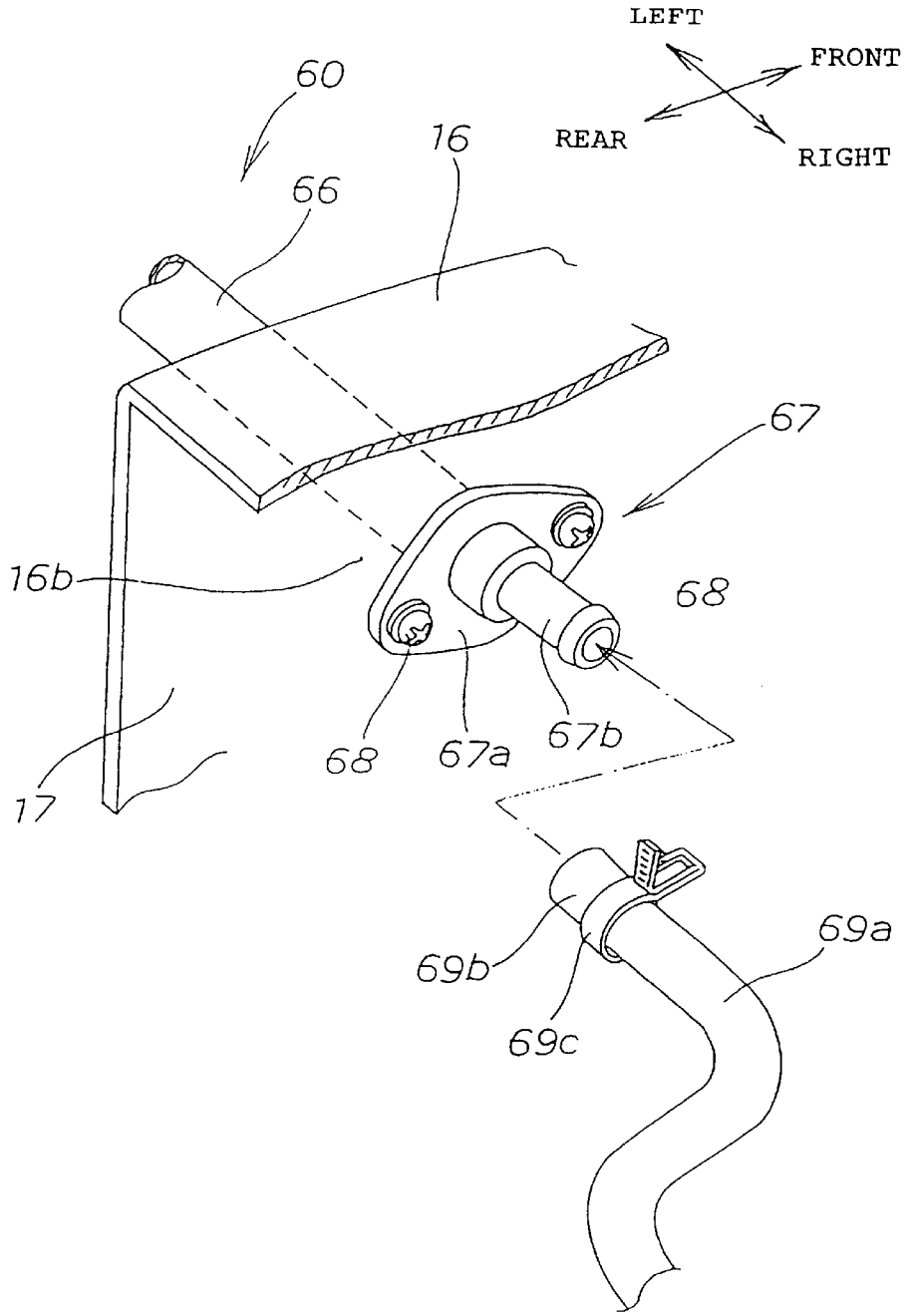
FIG. 7 is a perspective view of the cooling water discharge port (for cooling the engine) constituting the cooling system for a jet propulsion boat according to the present invention.

FIG. 7 is a perspective view of the cooling water discharge port (for cooling engine) constituting the cooling system for a jet propulsion boat according to the present invention.

The cooling system 40 for a jet propulsion boat shown in FIG. 4 is provided with the cooling water discharge port 67 of the engine-cooling flow path 60 in the vicinity of the opening 17 at the rear end of the jet pump chamber 16.

The cooling water discharge port 67 of the engine-cooling flow path 60 is a discharge port for discharging cooling water used for cooling the engine-cooling flow path 60 toward the outside, and serves also as a feed port for feeding washing water to the engine-cooling flow path 60 and the exhaust-system-cooling flow path 70.

The cooling water discharge port 67 is attached on the left side wall 16*b* of the jet pump chamber 16 in such a manner that a flange 67*a* is secured in the vicinity of the opening 17 at the rear end of the left side wall 16*b* with bolts 68, 68, and a nozzle 67*b* extends from the flange 67*a* so as to be orthogonal to the left side wall 16*b*.

When feeding washing water to the cooling water discharge port 67, a tap water hose 69*a* can be securely attached on the nozzle 67*b* of the cooling water discharge port 67 by fitting the tip 69*b* of the tap water hose 69*a* on the nozzle 67*b* of the cooling water discharge port 67, and tightening the outer periphery of the tap water hose 69*a* by the lock spring 69*c*.

Accordingly, since a disconnection of the tap water hose 69*a* from the nozzle 67*b* of the cooling water discharge port 67 may be prevented at the time of flashing (washing), a washing operation can be performed effectively in a short time.

By disposing the cooling water discharge port 67 in the vicinity of the opening 17 at the rear end of the jet pump chamber 16, it is possible to insert a hand into the jet pump chamber 16 through the opening 17 at the rear end of the jet pump chamber 16 and to easily touch the cooling water discharge port 67 with the inserted hand.

Therefore, when tap water is used as washing water for example, the tap water hose 69*a* for tap water can be attached to the nozzle 67*b* of the cooling water discharge port 67 relatively easily, and thus the washing operation can be performed easily without taking too much time and effort.

In addition, by providing the cooling water discharge port 67 of the engine-cooling flow path 60 in the vicinity of the opening 17 at the rear end of the jet pump chamber 16, the cooling water discharge port 67 can be hidden by the jet pump chamber 16.

As a consequent, the cooling water discharge port 67 can be hidden so as not to be viewed from the outside, and thus the appearance of the jet propulsion boat 10 can be improved.

Figure 8:
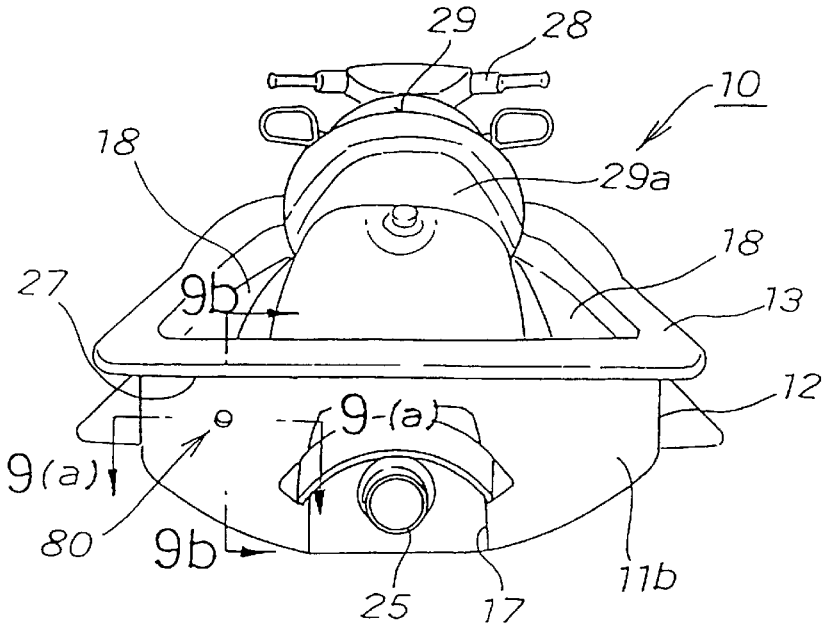
FIG. 8 is a perspective view of the cooling water discharge port (for cooling the exhaust system) constituting the cooling system for a jet propulsion boat according to the present invention.

FIG. 8 is a perspective view of the cooling water discharge port (for cooling the exhaust system) constituting the cooling system for a jet propulsion boat according to the present invention.

The cooling water discharge port 80 of the exhaust-system-cooling flow path 70 is a discharge port for discharging cooling water used for cooling the exhaust-system-cooling flow path 70 to the outside, and serves also as a water pilot hole for detecting whether of not the cooling system 40 for a jet propulsion boat functions normally.

The cooling water discharge port 80 is provided in the vicinity of the lower side of a joint 27 between the lower hull 12 and the upper hull 13 on the side of the lower hull 12.

Figure 9A:
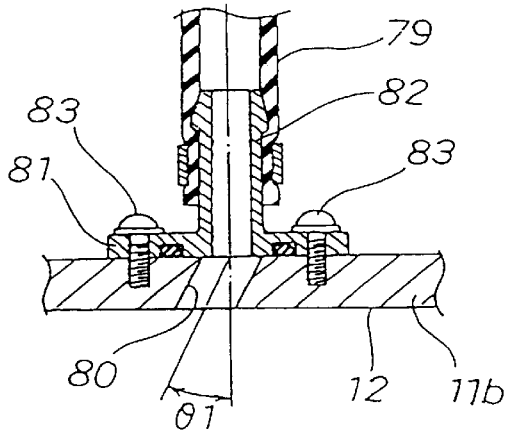
FIGS. 9(*a*) and 9(*b*) are cross-sectional views of the cooling water discharge port (for cooling the exhaust system) constituting the cooling system for a jet propulsion boat according to the present invention.
Figure 9B:
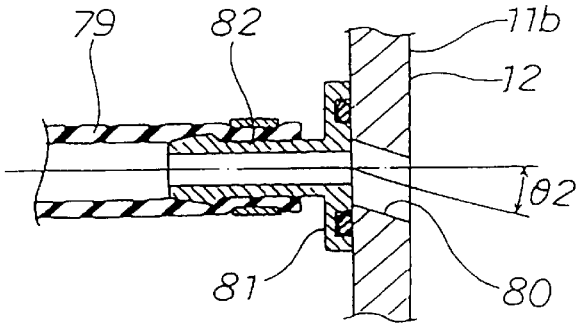

FIGS. 9(*a*) and 9(*b*) are cross-sectional views illustrating the cooling water discharge port (for cooling the exhaust system) constituting the cooling system for a jet propulsion boat according to the present invention. FIG. 9(*a*) is a cross-sectional view taken along the line 9*a*—9*a* in FIG. 8, and FIG. 9(*b*) is a cross-sectional view taken along the line 9*b*—9*b* in FIG. 8.

As shown in FIG. 9(*a*), the cooling water discharge port 80 of the exhaust-system-cooling flow path 70 is a through hole formed in the rear wall constituting the lower hull 12. The discharge port 80 is inclined outwardly by the angle of θ1.

The end of the exhaust-system-cooling flow path 70 can be brought into communication with the cooling water discharge port 80 by securing a flange 81 to the inner side of the rear surface 11*b* of the lower hull 12 with a bolt 83. An entry portion 82 extends from the flange 81 so as to be orthogonal to the rear surface 11*b*. The end of the exhaust-system-cooling flow path 70 is inserted into the entry portion 82.

As shown in FIG. 9(*b*), the cooling water discharge port 80 of the exhaust-system-cooling flow path 70 is inclined downward by the angle of θ2.

In this way, cooling water discharged from the cooling water discharge port 80 can be discharged to the outside of the vessel body 11 by inclining the cooling water discharge port 80 of the exhaust-system-cooling flow path 70 outwardly by the angle of θ2. Therefore, the occupant can easily verify that cooling water is discharged from the cooling water discharge port 80.

Since cooling water can be discharged to the lower side of the left and right decks 18, 18 (shown in FIG. 8) by inclining the cooling water discharge port 80 of the exhaust-system-cooling flow path 70 downwardly by the angle of θ2, it is further ensured that cooling water is prevented from entering to the side of the left and right decks 18, 18.

Referring now to FIG. 10 to FIG. 14, the operation of the cooling system for a jet propulsion boat will be described.

Figure 10A:
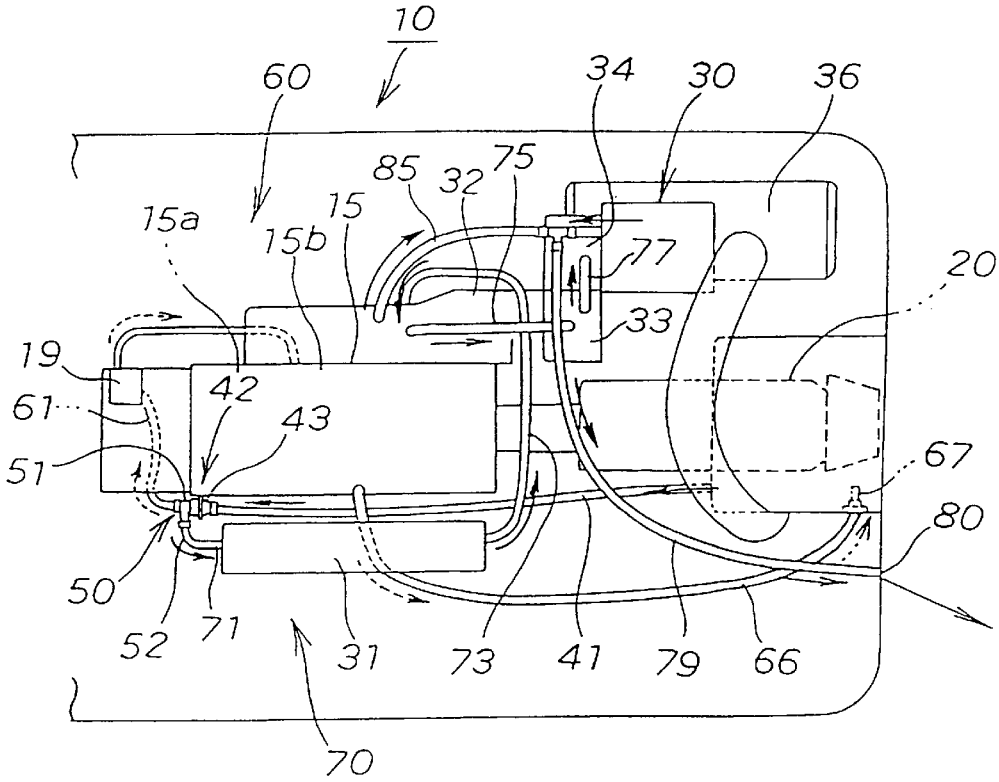
FIGS. 10(*a*) and 10(*b*) are first explanatory drawings illustrating an example in which the engine and the exhaust system are cooled by the cooling system for a jet propulsion boat according to the present invention.
Figure 10B:
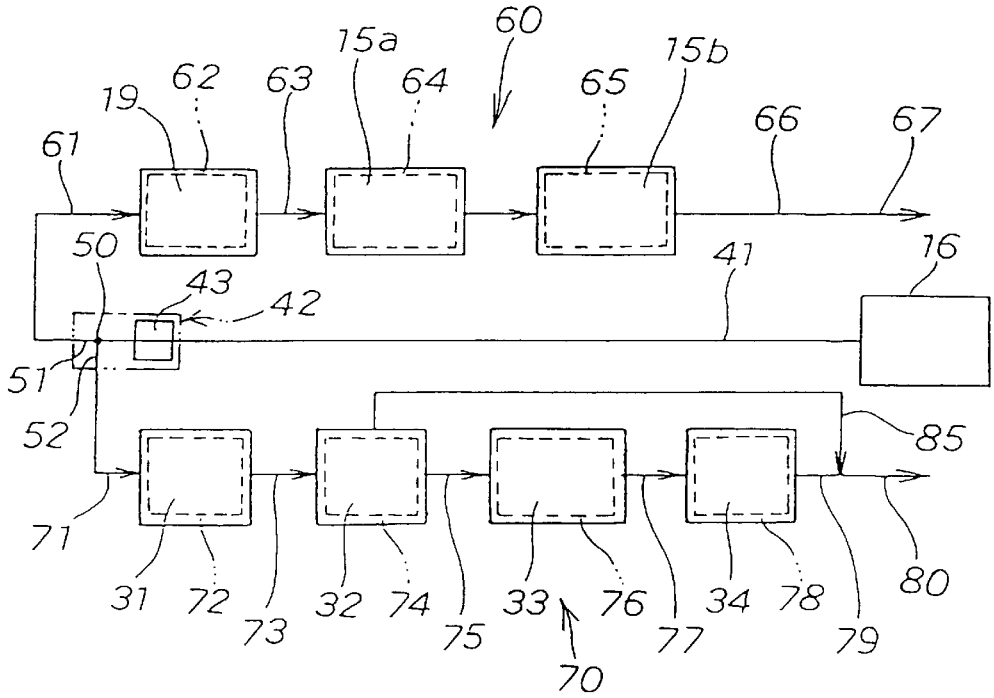

FIGS. 10(*a*) and 10(*b*) are first explanatory drawings illustrating an example in which the engine and the exhaust system are cooled by the cooling system for a jet propulsion boat according to the present invention.

When operating the jet propulsion boat 10, a part of a jet of water emitted from the jet pump 20 is taken into the intake path 41 as cooling water. The cooling water taken into the intake path 41 flows towards the diverging duct 50 through the one-way valve 43 of the one-way valve unit 42.

Cooling water flowing to the diverging duct 50 is diverged into the first diverged discharge port 51 and the second diverged discharge port 52. Cooling water diverged into the first diverged discharge port 51 flows into the engine-cooling flow path 60. Further, cooling water diverged into the second diverged discharge port 52 flows into the exhaust-system-cooling flow path 70.

Cooling water flowing into the engine-cooling flow path 60 flows into the feed port of the oil-cooler-cooling duct 62 through the first engine-cooling flow path 61 and then flows from the feed port into the oil-cooler-cooling duct 62 to cool the oil cooler 19. Cooling water used for cooling the oil cooler 19 flows through the discharge port of the oil-cooler-cooling duct 62 and the second engine-cooling flow path 60 into the feed port of the cylinder-block-cooling duct 64 and then flows from this feed port into the cylinder-block-cooling duct 64 to cool the cylinder block 15*a*.

Cooling water that was used for cooling the cylinder block 15*a* flows through the discharge port of the cylinder-block-cooling duct 64 to the feed port of the cylinder-head-cooling duct 65 and then flows from the feed port to the cylinder-head-cooling duct 65 to cool the cylinder head 15*b*.

Cooling water that was used for cooling the cylinder head 15*b* flows from the discharge port of the cylinder-head-cooling duct 65 into the third engine-cooling flow path 66 and then flows out through the third engine-cooling flow path 66 and the cooling water discharge port 67 to the outside. Accordingly the engine 15 is forced to be cooled by cooling water.

On the other hand, cooling water flowing into the exhaust-system-cooling flow path 70 flows through the first exhaust-system-cooling flow path 71 to the feed port of the intercooler-cooling duct 72 and then flows from the feed port into the intercooler-cooling duct 72 for cooling the intercooler 31.

Cooling water that was used for cooling the intercooler 31 flows through the discharge port of the intercooler-cooling duct 72 and the second exhaust-system-cooling flow path 73 to the feed port of the exhaust-manifold-cooling duct 74 and then flows from the feed port into the exhaust-manifold-cooling duct 74 for cooling the exhaust manifold 32.

Cooling water that was used for cooling the exhaust manifold 32 flows through the discharge port of the exhaust-manifold-cooling duct 74 and the third exhaust-system-cooling flow path 75 to the feed port of the turbocharger-cooling duct 76 and then flows from the feed port into the turbocharger-cooling duct 76 for cooling the turbocharger 33.

Cooling water that was used for cooling the turbocharger-cooling duct 76 flows through the discharge port of the turbocharger-cooling duct 76 and the fourth exhaust-system-cooling flow path 77 to the feed port of the exhaust-pipe-cooling duct 78 and then flows from the feed port into the exhaust-pipe-cooling duct 78 for cooling the exhaust pipe 34.

Cooling water that is used for cooling the exhaust pipe 34 flows into the discharge port of the exhaust-pipe-cooling duct 78 and the intake port of the fifth exhaust-system-cooling duct 79 and then flows from the intake port through the fifth exhaust-system-cooling flow path 79 and the cooling water discharge port 80 to the outside. Accordingly, the exhaust system 30 is forced to be cooled by cooling water.

Figure 11:
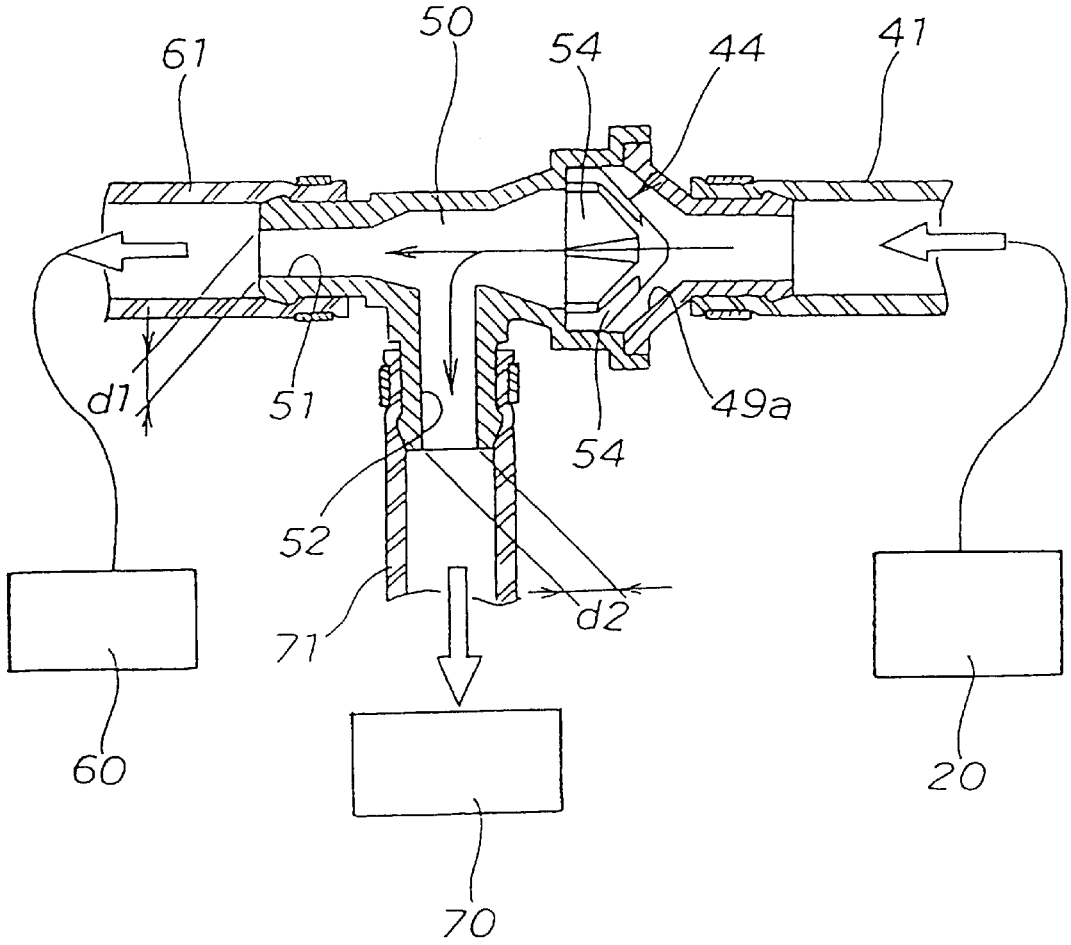
FIG. 11 is a second explanatory drawing illustrating an example in which the engine and the exhaust system is cooled by the cooling system for a jet propulsion boat according to the present invention.

FIG. 11 is a second explanatory drawing showing an example in which the engine and the exhaust system is cooled by the cooling system for a jet propulsion boat according to the present invention.

When cooling water flows from the intake path 41 towards the valve body 44, the valve body 44 is moved away from the valve seat 49*a* by the hydraulic pressure of cooling water, and is kept in a state of being away from the valve seat 49*a*. By moving the valve body 44 away from the valve seat 49*a*, cooling water flows from the intake path 41 to the diverging duct 50.

Cooling water flowing to the diverging duct 50 is diverged into the first diverged discharge port 51 and the second diverged discharge port 52. Cooling water diverged into the first diverged discharge port 51 flows into the engine-cooling flow path 60 and cooling water diverged into the second diverged discharge port 52 flows into the exhaust-system-cooling flow path 70.

The inner diameter d1 of the first diverged discharge port 51 and the inner diameter d2 of the second diverged discharge port 52 are set to be d1<d2, cooling water flown into the engine-cooling flow path 60 and cooling water flowing into the exhaust-system-cooling flow path 70 can be diverged into optimal quantities, respectively.

The cooling system 40 for a jet propulsion boat is provided at the midsection thereof with a one-way valve 43 for enabling cooling water to flow from the intake path 41 to the diverging duct 50 and preventing washing water from flowing from the diverged duct 50 towards the intake path 41.

As a consequent, when operating the jet propulsion boat 10, cooling water taken into the intake path 41 may flow into the diverging duct 50 through the one-way valve 43. Cooling water flowing into the diverging duct 50 is diverged into parts that flow into the first and second diverging duct discharge ports 51, 52, respectively, by the diverging duct 50. Cooling water flowing through the first diverging duct discharge port 51 can flow into the engine-cooling flow path 60, and cooling water flowing thorough the second diverging duct discharge port 52 can flow into the exhaust-system-cooling flow path 70.

Since cooling water can be separated into a part flowing thorough the engine-cooling flow path 60 and a part flowing through the exhaust-system-cooling flow path 70, the temperature of the engine 15 and of the exhaust system 30 can easily be controlled.

In addition, with the provision of the one-way valve 43 in the middle of the intake path 41, even when the engine 15 (that is, the jet pump 20) is stopped, the one-way valve 43 can prevent cooling water from flowing out from the engine-cooling flow path 60 and the exhaust-system-cooling flow path 70. Therefore, when the engine 15 is stopped, cooling water can remain in the engine-cooling flow path 60 or the exhaust-system-cooling flow path 70 for a certain period of time.

As a consequent, heat accumulation (portions at high temperature) in the engine 15 or the exhaust system 30 can be prevented from remaining because cooling water flows quickly out from the engine-cooling flow path 60 or the exhaust-system flow path 70.

Figure 12:
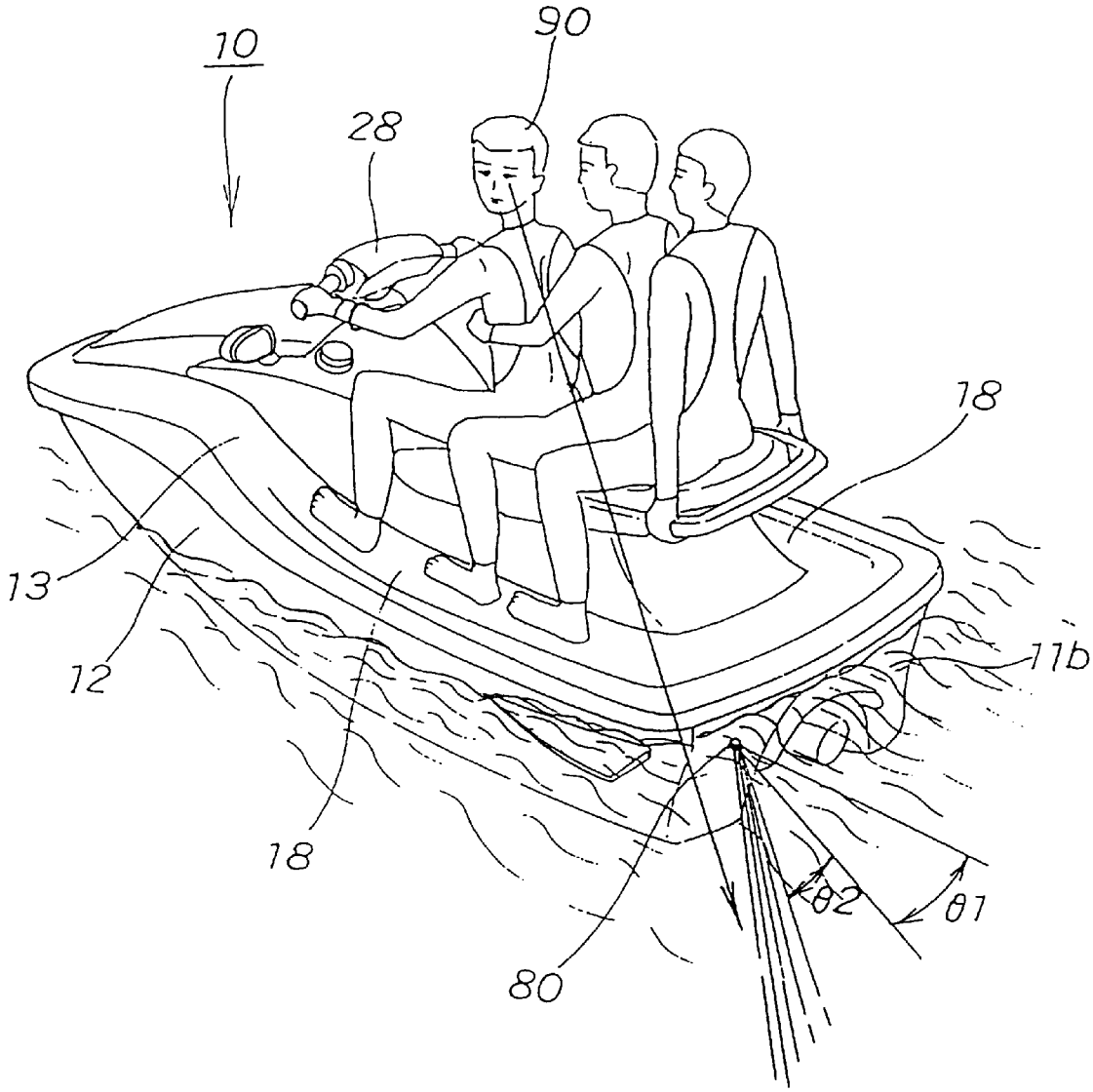
FIG. 12 is a third explanatory drawing illustrating an example in which the engine and the exhaust system are cooled by the cooling system for a jet propulsion boat according to the present invention.

FIG. 12 is a third explanatory drawing illustrating the example in which the engine and the exhaust system are cooled by the cooling system for a jet propulsion boat according to the present invention.

With the provision of the cooling water discharge port 80 of the exhaust-system-cooling flow path 70 on the rear surface 11*b* of the vessel body 11 except for the portion 29*a* immediately behind the saddle-riding type seat 29, cooling water discharged from the cooling water discharge port 80 is prevented from flowing into the footrest deck 18 or from splashing toward the footrest deck 18.

Furthermore, the opening of the cooling water discharge port 80 is positioned in the vicinity of the lower side of the joint 27 between the lower hull 12 and the upper hull 13 on the side of the lower hull 12. Therefore, the opening of the cooling water discharge port 80 is set to a position lower than the height of the footrest deck 18, and thus cooling water discharged from the cooling water discharge port 80 can reliably be prevented from flowing into the footrest deck 18 or from splashing towards the footrest deck 18.

In addition, with the construction in which the cooling water discharge port 80 of the exhaust-system-cooling flow path 70 is inclined downwardly by the angle of θ2 (See also FIG. 8(*b*)), cooling water can be discharged out downwardly of the left and right decks 18, 18 and thus cooling water is further reliably prevented from flowing into the left and right decks 18, 18 or from splashing towards the footrest deck 18.

On the other hand, the cooling water discharge port 80 of the exhaust-system-cooling flow path 70 is provided on the rear surface 11*b* of the vessel body 11, except for the portion 29*a* immediately behind the saddle-riding type seat 29, that is, at the portion offset from the portion 29*a* immediately behind the saddle-riding type seat 29. Therefore, cooling water discharged from the cooling water discharge port 80 can be easily verified by an occupant 90.

Furthermore, cooling water discharged from the cooling water discharge port 80 can be discharged towards the outside of the vessel body 11 by inclining the cooling water discharge port 80 of the exhaust-system-cooling flow path 70 towards the outside by the angle of θ1 (See also FIG. 8).

Therefore, the occupant 90 can verify that cooling water is easily discharged from the cooling water discharge port 80 and recognize that the cooling system 40 for a jet propulsion boat is functioning normally.

Figure 13A:
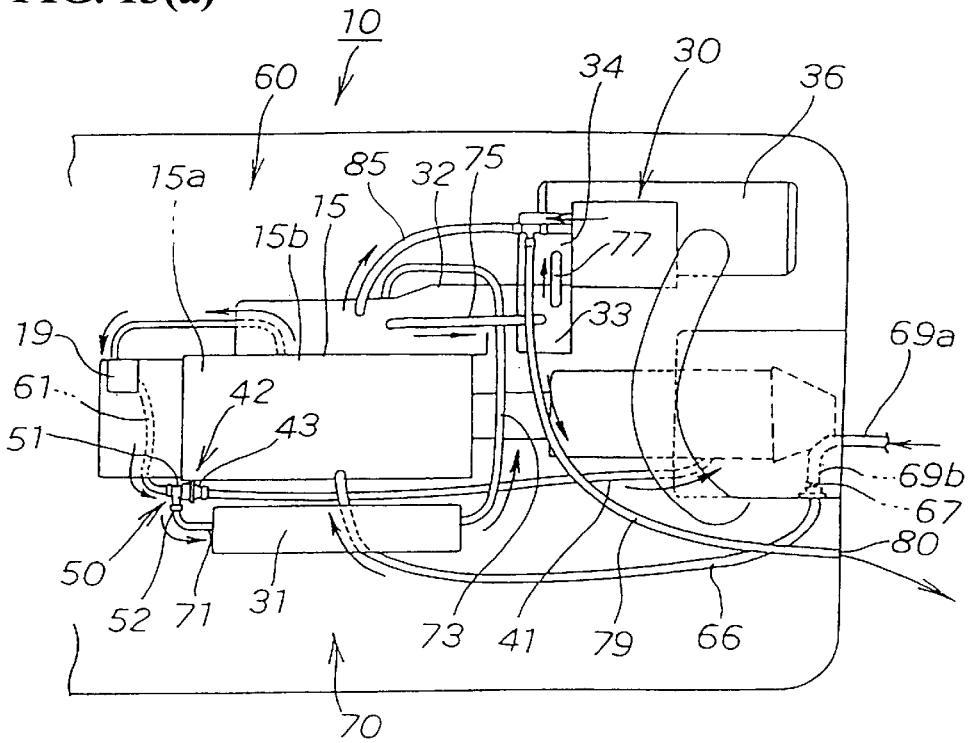
FIGS. 13(*a*) and 13(*b*) show first explanatory drawings illustrating an example in which the engine-cooling flow path and the exhaust-system-cooling flow path are washed by the cooling system for a jet propulsion boat according to the present invention.
Figure 13B:
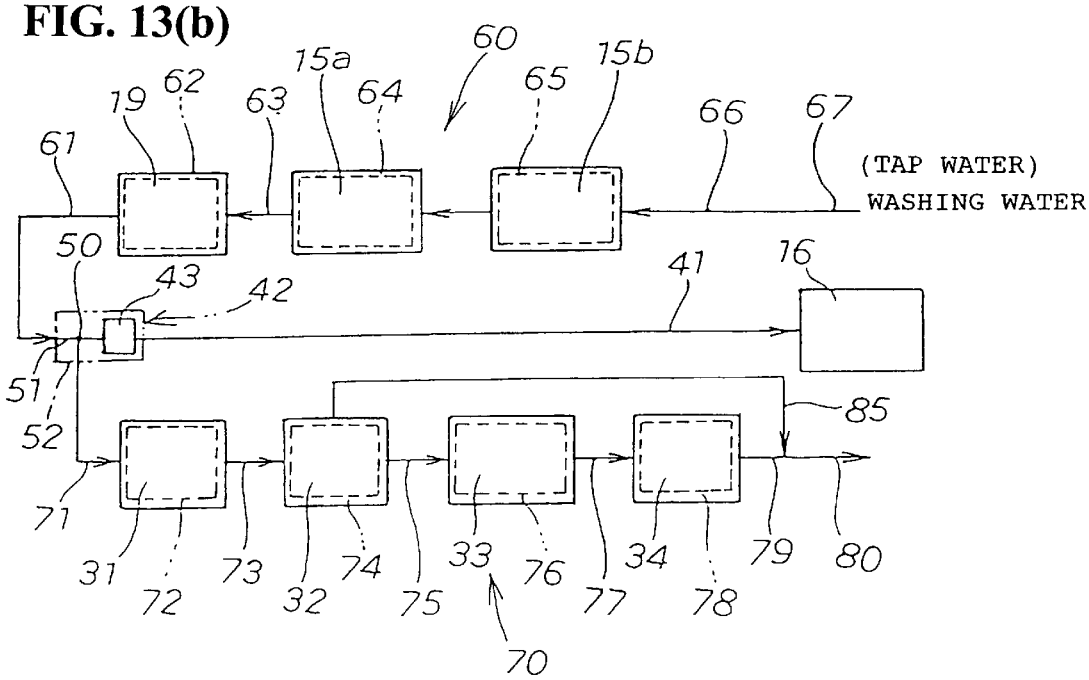

FIGS. 13(*a*), (*b*) are first explanatory drawings illustrating an example in which the engine-cooling flow path and the exhaust-system-cooling flow path are washed by the cooling system for a jet propulsion boat according to the present invention.

The tap water hose 69*a* for supplying tap water (washing water) is attached on the cooling water discharge port 67 and washing water flows from the tap water hose 69*a* through the cooling water discharge port 67 to the third engine-cooling flow path 66. Washing water flowing through the third engine-cooling flow path 66 flows into the cylinder-head-cooling duct 65 and washes the cylinder-head-cooling duct 65.

Washing water that was used for washing the cylinder-head cooling duct 65 flows into the cylinder-block cooling duct 64 for washing the cylinder-block cooling duct 64.

Washing water that is used for washing the cylinder-block cooling duct 64 flows through the second engine cooling flow path 63 into the oil-cooler-cooling duct 62 for washing the oil-cooler-cooling duct 62. Washing water that was used for washing the oil-cooler-cooling duct 62 flows into the first engine-cooling flow path 61 and then flows from the first engine-cooling flow path 61 through the first diverged discharge port 51 and reaches the diverging duct 50.

Most of cooling water out of washing water reaching the diverging duct 50 flows through the first exhaust-system-cooling flow path 71 to the feed port of the intercooler-cooling duct 72 and then flows through the intercooler-cooling duct 72 for washing the intercooler-cooling duct 72.

Washing water that was used for washing the intercooler-cooling duct 72 flows through the second exhaust-system-cooling flow path 73 to the exhaust-manifold-cooling duct 74 for washing the exhaust-manifold-cooling duct 74.

Washing water that was used for washing the exhaust-manifold-cooling duct 74 flows through the third exhaust-system-cooling flow path 75 to the turbocharger-cooling duct 76 to wash the turbocharger-cooling duct 76. Washing water that was used for washing the turbocharger-cooling duct 76 flows through the fourth exhaust-system-cooling flow path 77 to the exhaust-pipe-cooling duct 78 for washing the exhaust-pipe-cooling duct 78.

Washing water that was used for washing the exhaust-pipe-cooling duct 78 flows into the intake port of the fifth exhaust-system-cooling duct 79, and flows through the fifth exhaust-system-cooling flow path 79 and the cooling water discharge port 80 to the outside.

On the other hand, a small quantity of the washing water reaches the diverging duct 50 and flows through the fine flow paths 54*a* . . . of the one-way valve 43 (shown in FIG. 6(*b*)) towards the intake path 41. Accordingly, the interior of the jet pump 20 can easily be washed with a small quantity of washing water passing through the fine flow paths 54*a* . . .

Figure 14A:
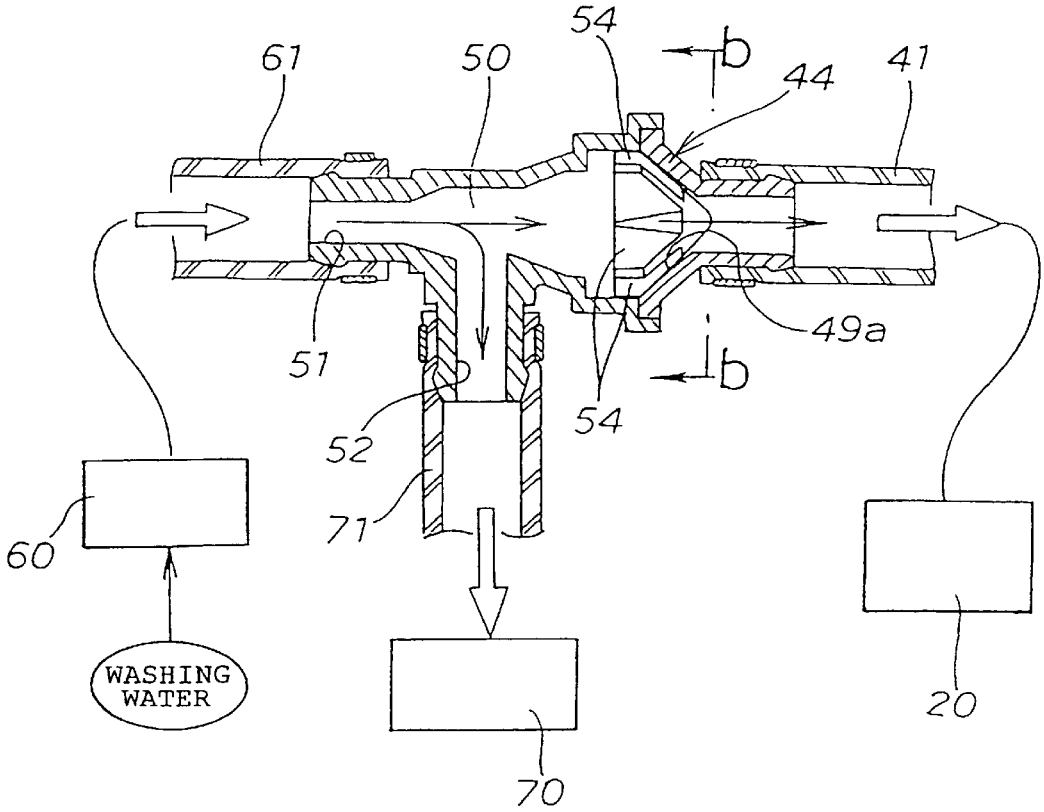
FIGS. 14(*a*) and 14(*a*) show second explanatory drawings illustrating an example in which the engine-cooling flow path and the exhaust-system-cooling flow path are washed by the cooling system for a jet propulsion boat according to the present invention.
Figure 14B:
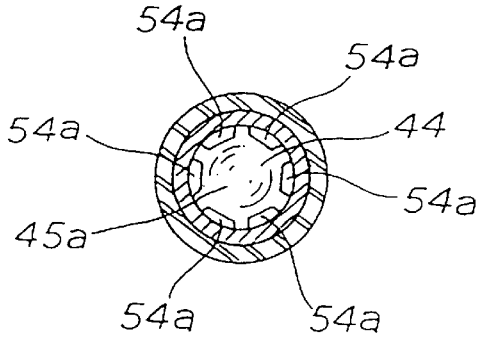
Figure 15:
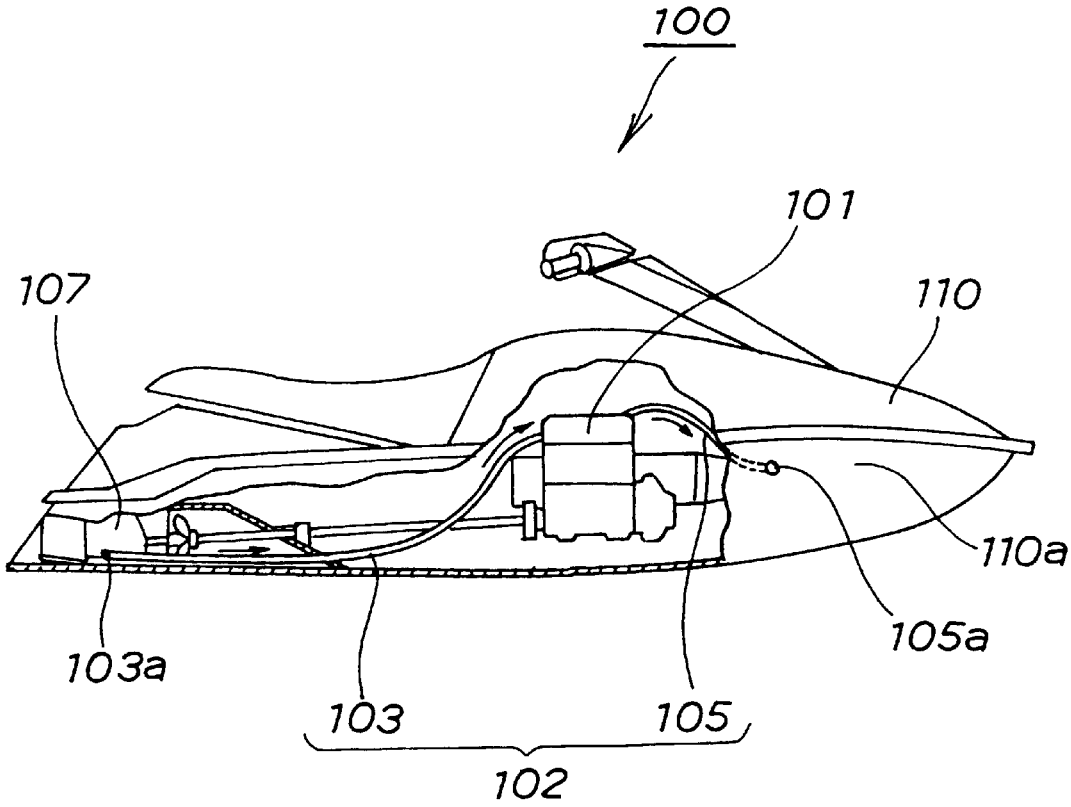
FIG. 15 BACKGROUND ART
FIG. 15 is a side view showing a jet propulsion boat in the related art.

FIGS. 14(*a*) and 14(*b*) are second explanatory drawings illustrating an example in which the engine-cooling flow path and the exhaust-system-cooling flow path are washed by the cooling system for a jet propulsion boat according to the present invention. FIG. 14(*a*) shows a cross section of the one-way valve unit. FIG. 14(*b*) shows a cross-sectional view taken along the line b—b in FIG. 14(*a*).

When washing water flows from the first diverged discharge port 51 to the diverging duct 50, the valve body 44 is brought into abutment with the valve seat 49*a* by the hydraulic pressure of washing water. Since most of the intake path 41 can be closed by the valve body 44 by bringing the valve body 44 into abutment with the valve seat 49*a,* most of washing water reaching the diverging duct 50 flows towards the second diverged discharge port 52.

The cooling system 40 for a jet propulsion boat can prevent washing water from flowing from the diverging duct 50 towards the intake path 41 when washing the jet propulsion boat 10. Accordingly, it is possible to wash the engine-cooling flow path 60 by supplying washing water to the engine-cooling flow path 60 and supply the washing water to the exhaust-system-cooling flow path 70 by the one-way valve 43.

Therefore, since washing water that was used for washing the engine-cooling flow path 60 can be used for washing the exhaust-system-cooling flow path 70 the quantity of washing water consumed can be reduced.

Since the fine flow paths 54*a* . . . can be formed between the valve body 44 and the intake path 41 as shown in FIG. 14(*b*) when the valve body 44 of the one-way valve 43 is brought into abutment against the valve seat 49*a,* a small quantity of washing water out of washing water reaching the diverging duct 50 flows towards the intake path 41 through the fine flow paths 54*a* . . . of the one-way valve 43.

Accordingly, the jet pump 20 can easily be washed by a small quantity of washing water passing through the fine flow paths 54*a* . . .

Though an example in which the oil cooler 19, the cylinder block 15*a,* and the cylinder head 15*b* are cooled in the engine-cooling flow path 60, and the intercooler 31, the exhaust manifold 32, the turbocharger 33, and the exhaust pipe 34 are cooled in the exhaust-system-cooling flow path 70 has been described in the aforementioned embodiment, the components to be cooled are not limited thereto, and may be determined according to the construction of the jet propulsion boat 10.

The present invention exercises the following effects with the construction described above.

According to the present invention, a one-way valve for enabling cooling water to flow from the intake path towards the diverging duct and preventing washing water from flowing from the diverging duct into the intake path is provided in the middle of the intake path.

As a consequent, when operating the jet propulsion boat, cooling water taken into the intake path can flow into the diverging duct through the one-way valve, and cooling water flown into the diverging duct can be diverged at the diverging duct and flow into the engine-cooling flow path and the exhaust-system-cooling flow path.

Cooling water flowing into the engine-cooling flow path and cooling water flowing into the exhaust-system-cooling flow path may be separated and thus it is easy to provide temperature control for the engine and temperature control for the exhaust system.

On the other hand, when washing the jet propulsion boat, washing water can be prevented from flowing from the diverging duct into the intake path with the one-way valve. Accordingly, it is possible to supply washing water into the engine-cooling flow path for washing the engine-cooling flow path with the supplied washing water and then to supply the washing water to the exhaust-system-cooling flow path through the one-way valve.

Therefore, washing water that is used for washing the engine-cooling flow path can be used for washing the exhaust-system-cooling flow path and thus the quantity of washing water consumed can be reduced.

According to the present invention, since the cooling water discharge port of the engine-cooling flow path is disposed in the vicinity of the opening at the rear end of the jet pump chamber, the cooling water discharge port can be hidden by the jet pump chamber. Accordingly, since the construction in which the cooling water discharge port cannot be viewed from the outside is realized, the appearance of the jet propulsion boat is improved.

In addition, with the provision of the cooling water discharge port in the vicinity of the opening at the rear end of the jet pump chamber, it is possible to insert a hand from the opening at the rear end of the jet pump chamber into the pump chamber and to easily touch the cooling water discharge port with the inserted hand. Therefore, even when tap water is used as washing water, a tap water hose can be attached to the cooling water discharge port relatively easily. Thus, the washing operation can be performed easily without taking too much time and effort.

According to the present invention, since the fine flow path can be kept opened when the one-way valve is closed, a small quantity of washing water can flow from the diverging duct toward the intake path through the fine flow path. Therefore, the jet pump can easily be washed with a small quantity of washing water passing through the fine flow path. Therefore, the jet propulsion boat can be washed effectively without taking too much time and effort.

In addition, since the quantity of washing water that passes through the fine flow paths is small, most part of washing water used for washing the engine-cooling flow path may be supplied to the exhaust-system-cooling flow path. Therefore, it is possible to wash the exhaust-system-cooling flow path effectively without taking too much time.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. In a jet propulsion boat comprising:

a vessel body;

a jet pump chamber provided in a rear portion of the vessel body;

a jet propulsion unit provided in a jet pump chamber, wherein as a jet of water is emitted for propulsion by driving the jet propulsion unit with an engine, a part of the jet of water is taken into an intake path as cooling water;

said cooling water taken into the intake path is diverted into a diverging duct and flows into an engine-cooling flow path and an exhaust-system-cooling flow path for cooling the engine and for cooling the exhaust system;

a cooling system comprising:

a one-way valve being provided in approximately a middle section of the intake path, said one-way valve being capable of opening for allowing cooling water to flow from the intake path towards the diverging duct and closing for preventing washing water from flowing from the diverging duct into the intake path.

2. The cooling system for a jet propulsion boat according to claim 1, wherein a cooling water discharge port of the engine-cooling flow path is disposed in the vicinity of the opening at the rear end of the jet pump chamber.

3. The cooling system for a jet propulsion boat according to claim 1, wherein the one-way valve is provided with a flow path for providing a small quantity of washing water to flow from the diverging duct into the intake path when closed.

4. The cooling system for a jet propulsion boat according to claim 1, wherein the intake path is connected to a casing, said one-way valve being mounted for movement within said casing for enabling cooling water to flow towards the diverging duct.

5. The cooling system for a jet propulsion boat according to claim 4, wherein said one-way valve includes a valve body having a core portion, said core portion being formed in the shape of a tapered cone at an extremity thereof with a diameter that is reduced from an area adjacent to the tapered cone rearwardly therefrom.

6. The cooling system for a jet propulsion boat according to claim 4, wherein said one-way valve includes a plurality of blades extending radially from an outer surface thereof.

7. The cooling system for a jet propulsion boat according to claim 1, wherein engine-cooling flow path is formed by an aperture of a first predetermined size and the exhaust-system-cooling flow path is formed by an aperture of a second predetermined size, wherein the aperture of the first predetermined size is smaller relative to the aperture of the second predetermined size.

8. The cooling system for a jet propulsion boat according to claim 1, wherein the one-way valve has a maximum width and the intake path has a predetermined size, wherein the maximum width of the one-way valve is smaller relative to the predetermined size of the intake path.

9. The cooling system for a jet propulsion boat according to claim 1, and further including a discharge port for the exhaust-system-cooling flow path, said discharge port being inclined by a predetermined angle relative to said exhaust-system-cooling flow path.

10. The cooling system for a jet propulsion boat according to claim 9, wherein said discharge port is offset from a centerline of the jet propulsion boat for enabling an operator to readily view the flow of cooling water from the discharge port.

11. A cooling system for use in a jet propulsion boat comprising:

an intake path for providing a flow of cooling water;

a valve unit in communication with said intake path for supplying cooling water to an engine-cooling flow path and an exhaust-system-cooling flow path for cooling an engine and for cooling an exhaust system;

a diverging duct provided within said valve unit for diverting the flow of cooling water to the engine-cooling flow path and the exhaust-system-cooling flow path;

a valve being provided in said valve unit, said valve being capable of opening for allowing cooling water to flow from the intake path towards the diverging duct and partially closing for preventing a full flow of washing water from flowing from the diverging duct into the intake path.

12. The cooling system for a jet propulsion boat according to claim 11, wherein a cooling water discharge port of the engine-cooling flow path is disposed in the vicinity of an opening at a rear end of a jet pump chamber.

13. The cooling system for a jet propulsion boat according to claim 11, wherein the valve is provided with a flow path for providing a small quantity of washing water to flow from the diverging duct into the intake path when partially closed.

14. The cooling system for a jet propulsion boat according to claim 11, wherein the intake path is connected to a casing, said valve being mounted for movement within said casing for enabling cooling water to flow towards the diverging duct.

15. The cooling system for a jet propulsion boat according to claim 14, wherein said valve includes a valve body having a core portion, said core portion being formed in the shape of a tapered cone at an extremity thereof with a diameter that is reduced from an area adjacent to the tapered cone rearwardly therefrom.

16. The cooling system for a jet propulsion boat according to claim 14, wherein said valve includes a plurality of blades extending radially from an outer surface thereof.

17. The cooling system for a jet propulsion boat according to claim 11, wherein engine-cooling flow path is formed by an aperture of a first predetermined size and the exhaust-system-cooling flow path is formed by an aperture of a second predetermined size, wherein the aperture of the first predetermined size is smaller relative to the aperture of the second predetermined size.

18. The cooling system for a jet propulsion boat according to claim 11, wherein the valve has a maximum width and the intake path has a predetermined size, wherein the maximum width of the valve is smaller relative to the predetermined size of the intake path.

19. The cooling system for a jet propulsion boat according to claim 11, and further including a discharge port for the exhaust-system-cooling flow path, said discharge port being inclined by a predetermined angle relative to said exhaust-system-cooling flow path.

20. The cooling system for a jet propulsion boat according to claim 19, wherein said discharge port is offset from a centerline of the jet propulsion boat for enabling an operator to readily view the flow of cooling water from the discharge port.

* * * * *